US005909772A

United States Patent [19]

Merkel et al.

[11] Patent Number: 5,909,772

[45] Date of Patent: Jun. 8, 1999

[54] APPARATUS AND METHOD FOR ESTIMATING LIQUID YIELD OF A GAS/CONDENSATE RESERVOIR

[75] Inventors: Richard H. Merkel, Evergreen; Michael J. Uland, Littleton, both of Colo.

[73] Assignee: Marathon Oil Company, Findlay, Ohio

[21] Appl. No.: 08/835,154

[22] Filed: Apr. 4, 1997

[51] Int. Cl.[6] ..... E21B 47/00

[52] U.S. Cl. ..... 166/250.16; 250/256; 250/266; 73/152.06; 73/152.08; 73/152.14

[58] Field of Search ..... 166/250.16; 250/256, 250/265, 266, 269.7; 73/152.06, 152.08, 152.14

[56] References Cited

U.S. PATENT DOCUMENTS 3,852,593 12/1974 Robinson ..... 250/259

4,095,102 6/1978 Tixier ..... 250/265

*Primary Examiner*—Roger Schoeppel

*Attorney, Agent, or Firm*—Jack L. Hummel; Jack E. Ebel

[57] ABSTRACT

Apparatus and method for determining a liquid yield from a gas/condensate reservoir. The apparatus and method first determines the porosity at each depth of a reservoir, using open hole logging techniques, before the well within the reservoir is used for production. Once the well is being used for production, a pulse neutron capture logging device is used to provide RICS and RATO data at each depth within the reservoir. The apparatus and method combines the RICS and RATO data, along with the porosity data, to provide a yield plot of an estimate of the liquid yield of the condensate in the reservoir at each depth within the reservoir. The apparatus and method further compares estimates made to any actual production data from the particular well being estimated and corrects constants within the estimating method to cause the estimates to match the production data. This feedback mechanism provides a more accurate estimate of the yield.

9 Claims, 5 Drawing Sheets

APPARATUS AND METHOD FOR ESTIMATING LIQUID YIELD OF A GAS/CONDENSATE RESERVOIR

TECHNICAL FIELD

This invention relates generally to enhanced oil recovery, and in particular to an apparatus and methods for estimating yield of the amount of liquid in a gas/condensate reservoir.

BACKGROUND OF THE INVENTION

In a gas condensate reservoir, the dense gas contained in the reservoir has liquid hydrocarbons in varying amounts dissolved in it, depending upon the geologic conditions of deposition and upon pressure and temperature conditions in the reservoir. The gas condensate can occur at various strata within the reservoir, wherein the amount of liquid yield at each depth may vary. Therefore, it is important to be able to estimate the amount of liquid hydrocarbon contained within the gas condensate at each depth of the reservoir.

One tool used to determine conditions within a reservoir is a pulse neutron capture logging device, exemplified by the PDK-100 device manufactured by Western Atlas International, Inc. The PDK-100 instrument uses a fast neutron (14 MeV) accelerator and two scintillation gamma ray detectors to measure sigma, the macroscopic neutron absorption cross section of sub-surface formations including fluids.

The PDK-100 instrument fires short bursts of fast neutrons into the formation at a rate of one burst per millisecond. Gamma rays, induced by neutron interactions in the borehole and the formation are measured and sorted into 100 equal-width gates for each of the two detectors. Two complete decay curves are thus obtained, each representing the neutron absorption rates in both the borehole and the formation.

The pulse neutron capture logging tool responds to both inelastic and capture gamma rays. When the formation is bombarded with neutrons, the neutrons are initially traveling very fast and when a neutron bounces off another atom, that atom emits gamma rays. These gamma rays are called inelastic gamma rays. As the neutrons travel further into the formation they lose energy and eventually arrive at a low enough energy state to allow them to be captured by other atoms. As a neutron is captured by an atom, gamma rays are again emitted. These gamma rays are called capture gamma rays. These two types of gamma rays are measured by the pulse neutron capture device and the ratio of these two gamma rays is plotted in a RICS (Ratio of Inelastic to Capture Spectra) plot.

As discussed above, the pulse neutron capture device contains two gamma ray detectors, called the near and far detectors. As the captured gamma rays are received by the pulse neutron capture device, they are detected by both the near and far detectors, and the ratio of the capture gamma rays by these two detectors is plotted in a curve called RATO.

The RICS and RATO plots respond to the type of minerals and fluids in the reservoir, including the amount of liquid within a gas condensate. The primary response of the RICS and RATO plots, however, is to the minerals within the formation, and not to the amount of liquid in the gas/condensate. Because the primary response is not to the amount of liquid, in the prior art, the amount of liquid indicated by the RICS and RATO plots could only be visually estimated by viewing the amount of separation between the RICS and RATO plots, to provide a qualitative estimate.

There is need in the art for a method of evaluating the RICS and RATO plots to provide a quantitative measurement of liquid yield within a reservoir. There is a further need for such an apparatus and method that adjusts for the porosity and minerals within the formation when estimating the yield. The present invention meets this and other needs in the art.

DISCLOSURE OF INVENTION

It is an aspect of the present invention to provide a method for estimating the liquid yield in a gas/condensate reservoir.

It is another aspect of the invention to provide such an estimate based upon data from a pulse neutron capture well logging device.

Another aspect of the invention is to determine the liquid yield estimate from the RICS and RATO data and porosity data at each depth within of a reservoir.

The above and other aspects of the invention are accomplished in an apparatus and method which first determines the porosity and minerology of each depth of a reservoir, using open hole logging techniques, before the well within the reservoir is used for production. Once the well is being used for production, a pulse neutron capture logging device is used to provide RICS and RATO data at each depth within the reservoir.

The present invention combines the RICS and RATO data, along with the porosity data, to provide a yield plot of an estimate of the liquid yield of the condensate in the reservoir at each depth within the reservoir.

The invention further compares estimates made to any actual production data from the particular well being estimated and corrects constants within the estimating method to cause the estimates to match the production data. This feedback mechanism provides a more accurate estimate of the yield.

The invention also includes a system for producing a gas/condensate within a gas/condensate reservoir, that has a means for measuring a porosity of minerals at each depth within the reservoir, a means for extending a pulse neutron capture logging tool into the reservoir and measuring RICS and RATO data at each depth within the reservoir, a means for combining the porosity, the RICS and RATO data at each depth to create a yield at each depth, a means for plotting the yield for each depth, a means for selecting a depth from the plot that provides a desired yield, and a means for perforating a casing of a well within the reservoir at the depth selected to produce the gas/condensate from the reservoir.

DESCRIPTION OF THE DRAWINGS

The above and other aspects, features, and advantages of the invention will be better understood by reading the following more particular description of the invention, presented in conjunction with the following drawings, wherein.

BEST MODE FOR CARRYING OUT THE INVENTION

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
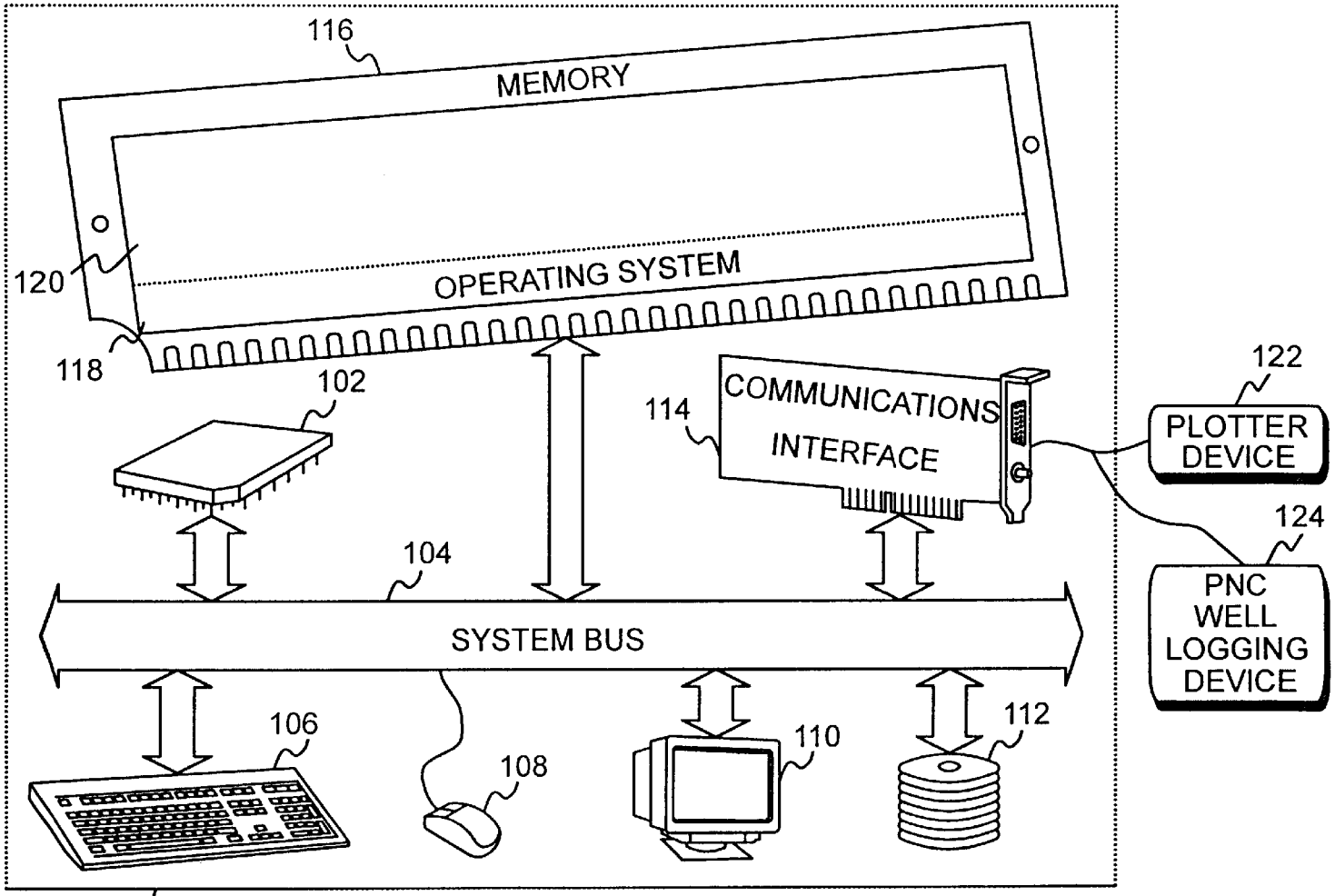
FIG. 1 shows a block diagram of a computer system including the yield estimating system of the present invention.

FIG. 1 shows a block diagram of a computer system containing the yield estimating system of the present invention. Referring to FIG. 1, a computer system 100 contains a processing element 102 which communicates to other elements of the computer system 100 over a system bus 104. A keyboard 106 and a mouse device 108 allow input to the computer system 100 while a graphics display device 110 allows software within the computer system 100 to output text and graphical information to a user of the computer system 100. A disk 112 contains the software and data used in the present invention.

A memory 116 contains an operating system 118, which could be any one of a number of commercially available operating systems. The memory 116 also contains the yield estimating system 120 of the present invention. The yield estimating system receives open hole logging information, determines a plot of porosity from the open hole logging information, using well known methods, and stores this plot on the disk 112. Once a well is producing, the yield estimating system 120 receives data from the PNC Well Logging Device 124 and stores this data on the disk 112. The yield estimating system 120 then extracts the data from the disk 112 and creates a plot of the yield at each depth. This plot is then is sent through a communications interface 114 to a plotter device 122. In addition to being plotted, the yield data is used to select an optimal location to perforate the casing of the well to produce an acceptable yield of liquid from the condensate.

Figure 2:
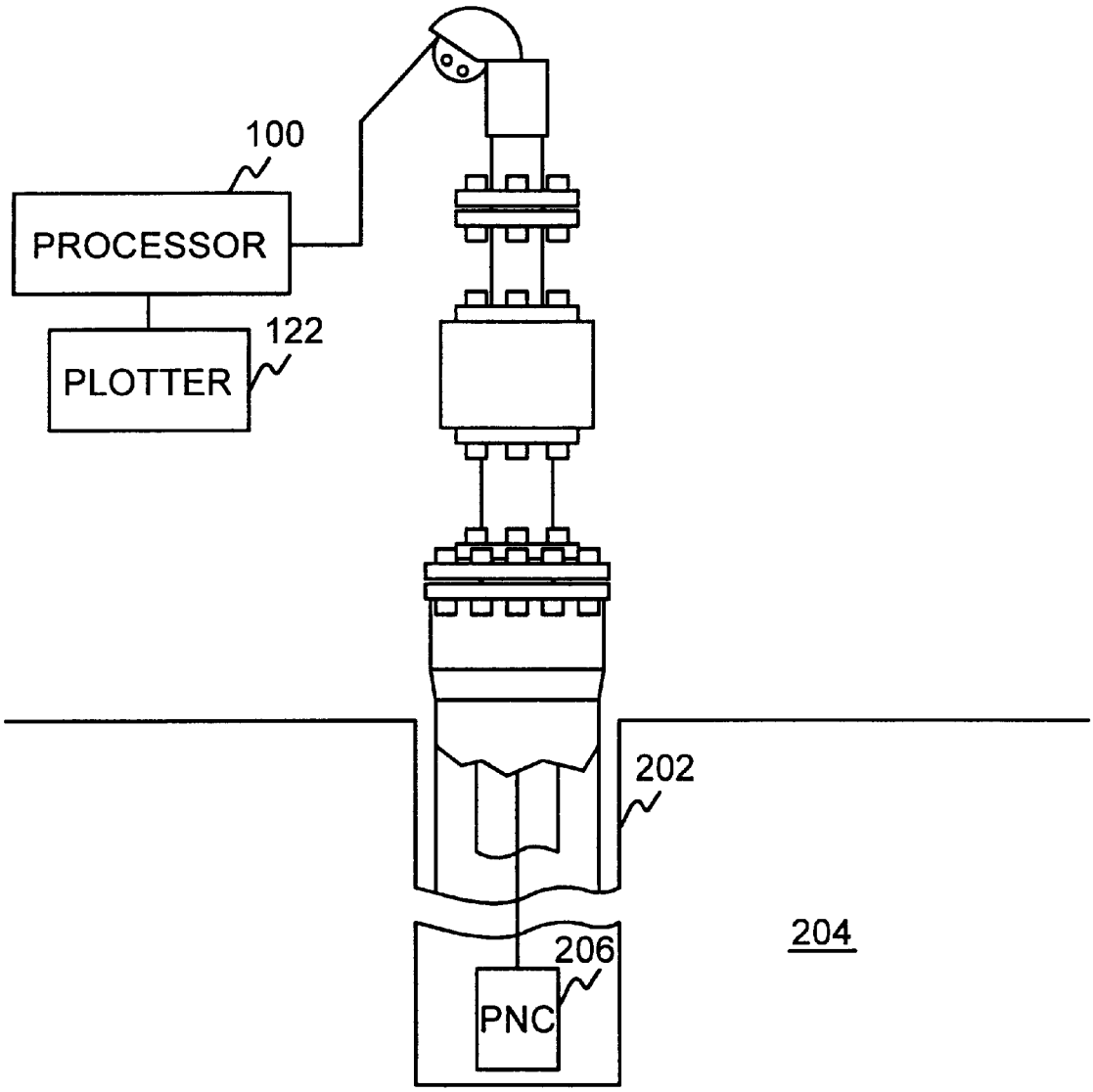
FIG. 2 shows a cross-section of a well penetrating a reservoir, including the PNC logging tool and computer system containing the yield estimating system of the present invention.

FIG. 2 shows a cross section of a well, or borehole, penetrating a reservoir that contains gas/condensate. Referring to FIG. 2, a borehole 202 penetrates a reservoir 204. Within the borehole 202, a pulse neutron capture well logging device 206 is used to capture RICS and RATO data for use with the present invention. The pulse neutron capture device 206 is moved through all the depths of interest within the borehole 202 and data is sent from the PNC device 206 to the processor 100, to the disk 112, and on into the yield estimating system 120 (shown in FIG. 1). The yield estimating system 120 then takes the data from the PNC 206 and plots the yield information on the plotter 122.

Figure 5:
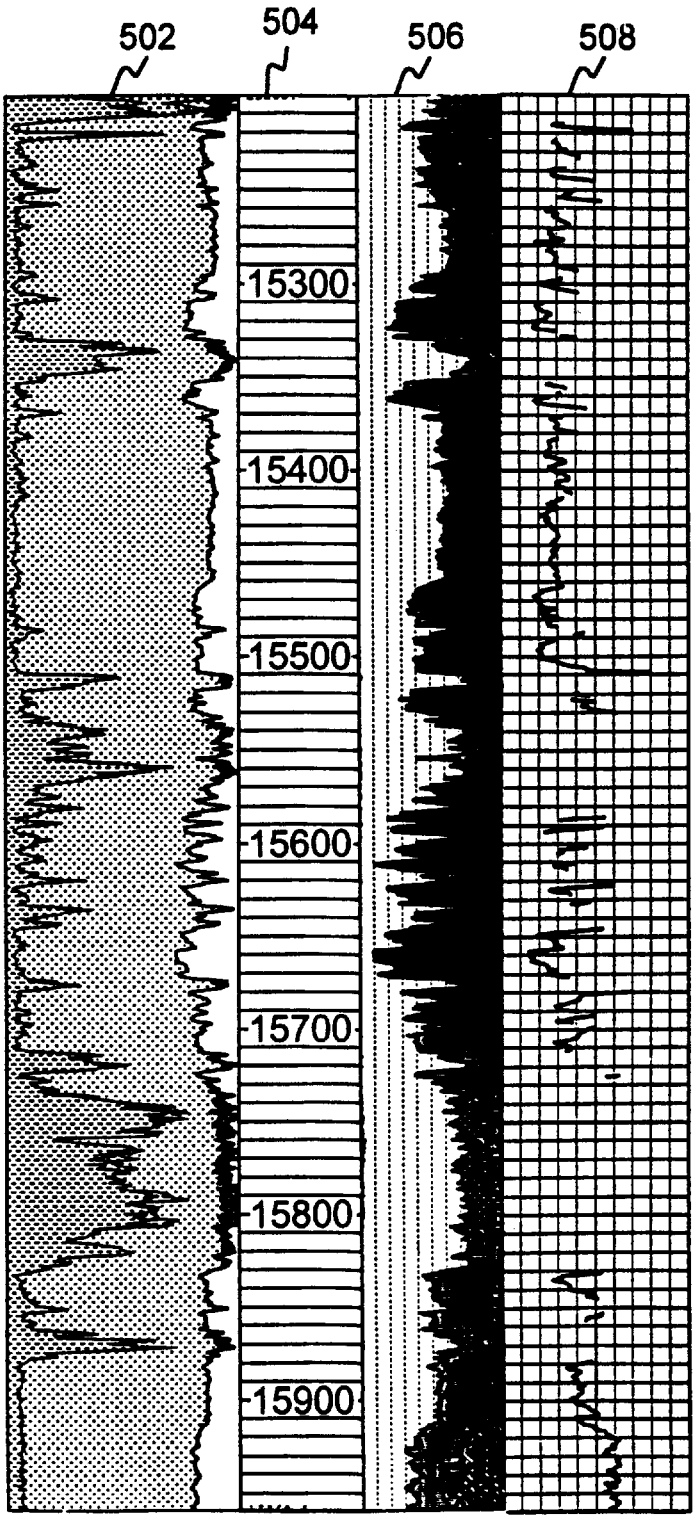
FIG. 5 shows an example plot of the porosity and yield curve for the well of FIG. 4.

The present invention needs three types of information in order to plot a yield curve of the liquid yield from the gas/condensate within the reservoir. The first type of information, porosity, is obtained through open hole logging information when the well is first drilled. The porosity information depends on the types of mineral at each level within the well, and from knowing the type of mineral contained at each level, the porosity of that mineral can be determined. An example of porosity data is shown in FIG. 5 and described below.

The next two types of information are determined from production logs after the well is in operation. The first of these two types is called RICS which is the ratio of the inelastic to capture spectra produced by the pulse neutron capture logging tool, as described above. The second of these two types is the RATO plot, which is the ratio of the capture gamma rays from the two sensors in the pulse neutron capture device, as described above.

The RATO and RICS curves primarily respond to the minerals within the formation, however, a secondary effect of these two curves is to respond to the amount of liquid contained within the condensate in those area of the formation that contain condensate. Because the primary response of the RATO and RICS curves is to the minerals within the formation, in order to correctly estimate yield, the porosity of the minerals must be considered in the yield equation.

Figure 3:
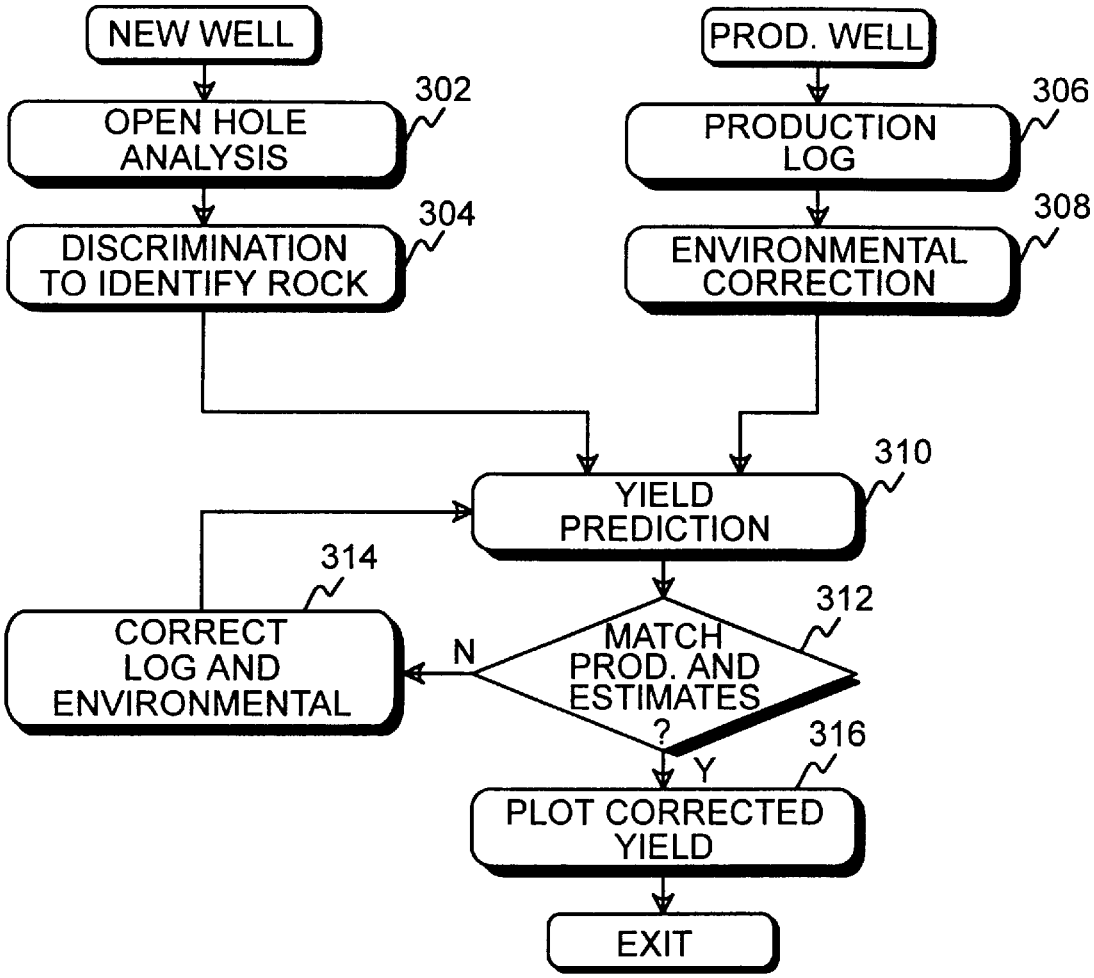
FIG. 3 shows a flowchart of the present invention.

FIG. 3 shows a flowchart of the yield estimating process of the present invention. Referring now to FIG. 3, block 302 performs an open hole analysis of a new well to determine the type of minerals contained in the formation through which the well penetrates. Block 304 applies discrimination to the open hole analysis determined in block 302 in order to identify the particular type of rock contained within the formation. Once the type of rock is known, the porosity of that rock is also known, thus the porosity can be input to the yield prediction block 310. An example of the plot of porosity is shown below with respect to FIG. 5.

Once a well is producing, block 306 runs a production log on the well using the pulse neutron capture device described above. When data are being compared from two different wells, block 308 environmentally corrects the data if those two wells should have different types of casing within them. Since two different types of casing would interfere in different ways with the neutrons and the gamma rays, corrections need to be applied so that the wells can be evaluated under the same conditions. Data is also environmentally corrected for whether the well is producing (flowing) or not producing (shut-in) at the time the measurement was made. In the preferred embodiment, the data was normalized to flowing conditions, 6.625 inch casing.

After being environmentally corrected, the RATO and RICS data are input to the yield prediction block 310. Block 310 makes the yield prediction using the equation:

$$YIELD=A+B*RATO^{b}+C*RICS^{c}+D*PHIE^{d}$$

where YIELD represents barrels of oil per million cubic feet of gas/condensate. This equation is applied at each depth of the well, or at those depths known to have gas/condensate, to produce a plot of yield. An example of this plot is shown below with respect to FIG. 5.

The constants A, B, b, C, d, D, and d in this equation are derived by inputting RATO, RICS, PHIE, and known YIELD data into the commercially available SAS Statistical Analysis System. The SAS system performs a statistical analysis to derive the constants to the equation.

Another technique for deriving the constants to the equation is to use RATO, RICS, PHIE and YIELD data from a second modeling system that is known to be accurate over the range being used to derive the constants. This data is also input to SAS, or another statistical modeling system, to derive the constants.

After the yield prediction is made, control goes to block 312 which then matches the production data from the well to the yield estimate, for those areas in which production has already occurred. Additionally, the yield created in block 310 can be matched against other estimates of yield prepared for the well using other methods. If the production data or other estimates do not match the prediction arrived at in block 310, control goes to block 314 which provides additional environmental corrections to the constants within the yield equation so that the yield equation prediction will match the actual production for those areas in which production has occurred or for which data from the other estimating methods was used. This provides a feedback mechanism to correct for environmental conditions within the well. That is, when production has occurred from the well at certain depths, the yield equation can be corrected so that it produces a correct yield for those depths, and once it produces a correct yield for the depths at which production has occurred, it will produce a correct yield for all other depths within the well, because the environmental conditions within that well are constant at that time.

After the yield prediction is corrected to match current production of the well, block 312 transfers to block 316 which plots the corrected yield on the plotter device 122 (FIG. 1). The yield plot is then reviewed to determine the depth at which the well casing should be perforated in order to achieve an optimal liquid yield from the condensate.

Figure 4:
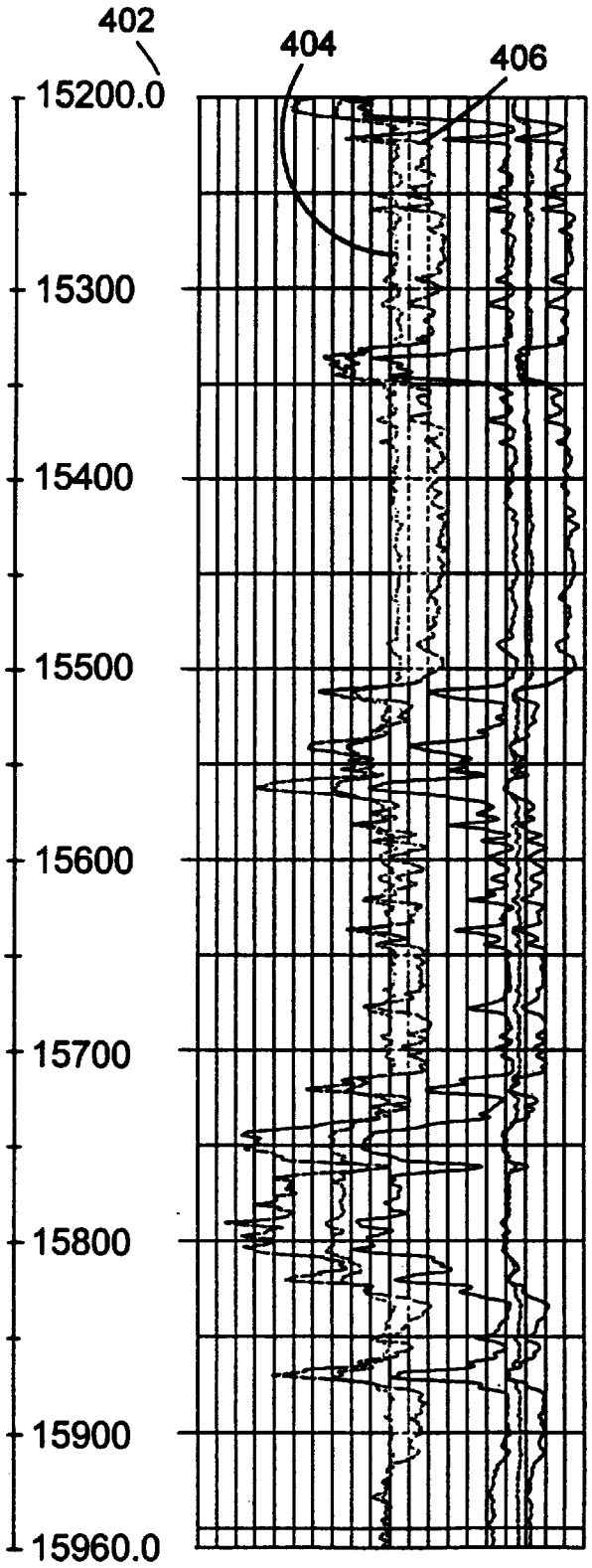
FIG. 4 shows example plots of the RICS and RATO values for a well.

FIG. 4 shows an example plot of RICS and RATO data for an example well. Referring to FIG. 4, The RICS plot is the dotted line 404, and the RATO plot is the dashed line 406, with depth indicated in column 402. Separation of these data alone does not identify the amount of liquid yield that can be obtained from the gas condensate. As described above, prior art methods could provide a qualitative estimate by observing the separation between the RICS and RATO plots, however, this did not provide any quantitative estimate for particular depths.

FIG. 5 shows an example plot of porosity and yield for the same example well, and for the same depths, as was shown in FIG. 4. Referring to FIG. 5, lithology plot 502 shows the various types of minerals in the formation, at the depths shown on the depth scale 504. PHIE 506 indicates the porosity of the minerals, and YIELD 508 shows the predicted yield in barrels per million cubic feet of gas/condensate at each of the depths. The equation also used the RICS 402 and RATO 404 data of FIG. 4, in the YIELD equation above, wherein the constants are:

A=−33
B=39.756
C=0.1709
D=−0.1786
b=1
c=2
d=2

These constants were derived from the commercially available SAS statistical analysis system, by inputting the RICS, RATO and porosity data shown above, along with the known production rates of the example well, as described above.

Having thus described a presently preferred embodiment of the present invention, it will now be appreciated that the aspects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A method for determining a liquid yield from a gas/condensate within a gas/condensate reservoir, said method comprising the steps of:

(a) measuring a porosity of minerals at each depth within said reservoir;

(b) extending a pulse neutron capture logging tool into said reservoir and measuring RICS and RATO data at each depth within said reservoir;

(c) combining said porosity, said RICS and said RATO data at each depth to create a yield at each depth;

(d) plotting said yield created in step (c) for each depth;

(e) selecting a depth from said plot produced in step (d) to provide a predetermined yield; and (f) perforating a casing of a well within said reservoir at said depth selected in step (e).

2. The method of claim 1 wherein step (c) further comprises the steps of:

(c1) at each depth, comparing said yield created in step (c) to a value of liquid produced from said reservoir; and (c2) correcting said yield to cause it to conform to said value of liquid produced from said reservoir at said depth.

3. The method of claim 1 wherein step (c) further comprises the step of combining said porosity, said RICS, and said RATO data using the equation $$YIELD=A+B*RATO^{b}+C*RICS^{c}+D*PHIE^{d}$$

wherein A, B, b, C, c, D, and d are constants and PHIE is porosity.

4. A method for producing a gas/condensate within a gas/condensate reservoir, said method comprising determining a liquid yield from a gas/condensate by the steps of:

(a) measuring a porosity of minerals at each depth within said reservoir;

(b) extending a pulse neutron capture logging tool into said reservoir and measuring RICS and RATO data at each depth within said reservoir;

(c) combining said porosity, said RICS and said RATO data at each depth to create a yield at each depth;

(d) plotting said yield determine in step (c) for each depth;

(e) selecting a depth from said plot produced in step (d) to provide a predetermined yield; and (f) perforating a casing of a well within said reservoir at said depth selected in step (e) and producing the gas/condensate from the reservoir.

5. The method of claim 4 wherein step (c) further comprises the steps of:

(c1) at each depth comparing said yield determined in step (c) to a value of liquid produced from said reservoir; and (c2) correcting said yield to cause it to conform to said value of liquid produced from said reservoir at said depth.

6. The method of claim 4 wherein step (c) further comprises the step of combining said porosity, said RICS, and said RATO data using the equation $$YIELD=A+B*RATO^{b}+C*RICS^{c}+D*PHIE^{d}$$

wherein A, B, b, C, c, D, and d are constants and PHIE is porosity.

7. A system for producing a gas/condensate within a gas/condensate reservoir, said system comprising:

means for measuring a porosity of minerals at each depth within said reservoir;

means for extending a pulse neutron capture logging tool into said reservoir and measuring RICS and RATO data at each depth within said reservoir;

means for combining said porosity, said RICS and said RATO data at each depth to create a yield at each depth;

means for plotting said yield for each depth;

means for selecting a depth from said plot produced in step (d) to provide a predetermined yield; and means for perforating a casing of a well within said reservoir at said depth selected in said means for selecting a depth, and for producing the gas/condensate from the reservoir.

8. The system of claim 7 wherein said means for combining further comprises:

means for comparing, at each depth, said yield determined in said means for combining to a value of liquid produced from said reservoir; and means for correcting said yield to cause it to conform to said value of liquid produced from said reservoir at said depth.

9. The system of claim 7 wherein said means for combining further comprises a means for combining said porosity, said RICS, and said RATO data using the equation $$YIELD=A+B*RATO^{b}+C*RICS^{c}+D*PHIE^{d}$$

wherein A, B, b, C, c, D, and d are constants and PHIE is porosity.

* * * * *